US005595690A

United States Patent [19]

Filburn et al.

[11] Patent Number: 5,595,690

[45] Date of Patent: Jan. 21, 1997

[54] METHOD FOR IMPROVING WATER TRANSPORT AND REDUCING SHRINKAGE STRESS IN MEMBRANE HUMIDIFYING DEVICES AND MEMBRANE HUMIDIFYING DEVICES

[75] Inventors: Thomas P. Filburn, Granby; John C. Huddleston, Poquonock; Dean A. Killelea, Winsted, all of Conn.

[73] Assignee: Hamilton Standard, Windsor Locks, Conn.

[21] Appl. No.: 570,295

[22] Filed: Dec. 11, 1995

[51] Int. Cl.[6] ..... B01F 3/04

[52] U.S. Cl. ..... 261/104; 264/510; 264/DIG. 78

[58] Field of Search ..... 261/104; 264/DIG. 78, 264/510

[56] References Cited

U.S. PATENT DOCUMENTS

| | | | |
|---|---|---|---|
| 2,660,757 | 12/1953 | Smith et al. | 264/DIG. 78 |
| 3,012,918 | 12/1961 | Schaar . | |
| 3,369,343 | 2/1968 | Robb | 261/104 |
| 3,400,919 | 9/1968 | Schall | 261/104 |
| 3,735,559 | 5/1973 | Salemme | 261/104 |
| 3,823,209 | 7/1974 | Birckhead, Jr. et al. | 264/DIG. 78 |
| 4,115,611 | 9/1978 | Stoltze et al. | 264/510 |
| 4,201,612 | 5/1980 | Figge et al. | 264/DIG. 78 |
| 4,317,792 | 3/1982 | Raley et al. . | |
| 4,559,199 | 12/1985 | Jensen . | |
| 4,604,156 | 8/1986 | Raley et al. . | |
| 4,695,422 | 9/1987 | Curro et al. . | |
| 4,765,942 | 8/1988 | Christensen et al. | 264/510 |
| 4,772,444 | 9/1988 | Curro et al. . | |
| 4,797,246 | 1/1989 | Reinke et al. . | |
| 5,269,981 | 12/1993 | Jameson et al. . | |
| 5,318,731 | 6/1994 | Yokoya et al. | 261/104 |
| 5,342,521 | 8/1994 | Bardot et al. . | |
| 5,348,691 | 9/1994 | McElroy et al. . | |
| 5,376,127 | 12/1994 | Swanson . | |

*Primary Examiner*—Tim R. Miles

*Attorney, Agent, or Firm*—Mary R. Bonzagni, Esq.; Holland & Bonzagni

[57] ABSTRACT

A method for improving water transport and reducing shrinkage stress in membrane humidifying devices, and membrane humidifying devices and systems employing such devices that achieve enhanced and stable humidification performance, are disclosed. The inventive membrane humidifying device is made up of at least one membrane cell and means for introducing water into the cell(s). The membrane cell(s) includes at least one sheet of a hydrophilic membrane and at least one rigid screen, positioned adjacent to at least one membrane sheet. The cell(s) is assembled when the membrane sheet(s) is in a dry, contracted state and the assembled cell(s) is then exposed to an elevated temperature/vacuum treatment. As a result, the surfaces of the membrane sheet(s) permanently conform to the contours of an adjacent rigid screen.

20 Claims, 3 Drawing Sheets

METHOD FOR IMPROVING WATER TRANSPORT AND REDUCING SHRINKAGE STRESS IN MEMBRANE HUMIDIFYING DEVICES AND MEMBRANE HUMIDIFYING DEVICES

FIELD OF THE INVENTION

The present invention relates to membrane humidifying devices that can be used in aircraft environmental systems and in commercial and home ventilation systems. The present invention more particularly relates to membrane humidifying devices that employ membranes having treated membrane surfaces and that achieve increased air humidification rates.

BACKGROUND OF THE INVENTION

Humidifying devices for humidifying air supplied to an enclosure or the like are known. The most notable of these prior art devices are misting devices that mechanically sling fine water droplets into a dry air stream with the idea that, if the droplets are small enough, they will quickly be absorbed and thus humidify the air.

One notable application for these humidifying devices is in aircraft environmental systems that provide humidified fresh air to crew members and passengers. The source of air for these systems is the air outside the aircraft which, at high altitudes, is extremely dry. After a few hours in this dry environment, crew members and passengers can become quite uncomfortable. This is especially true for crew members where high fresh-air flows are maintained to assure alertness. For these reasons, the fresh air delivered to crew members is often humidified on long flights.

The prior art humidifying devices have been found to be troublesome in several areas. The troublesome aspects of these devices create potentially adverse health and comfort conditions for persons exposed to the humidified air produced. In particular, bacteria can grow within these humidifying devices and can be readily dispelled with the humid fresh air. In addition, these devices allow liquid droplets to be delivered with the fresh air. Moreover, the potable water source for these devices usually contains minerals which eventually clog or foul equipment and, as a result, such minerals are dispelled with the air and leave deposits on exposed articles, such as electronic equipment. Accordingly, humidifying devices that correct these known deficiencies of the prior art devices have been sought.

Commonly assigned U.S. Pat. No. 5,348,691 to McElroy et al. discloses a membrane humidifying device that seeks to correct these deficiencies. The subject device comprises at least one membrane cell made up of at least one sheet of a hydrophilic membrane and at least one screen. The membrane cells are typically assembled when the membrane sheet(s) is wet and distended. In a preferred embodiment, two membranes are clamped in a frame and two screens, located between the membranes, are either clamped in the frame or loosely contained within the channel defined by the membranes.

Although such devices render acceptable humidification performance there is a need for membrane humidifying devices that provide increased humidification rates.

Moreover, it has been observed that during the cyclic operation of the devices of U.S. Pat. No. 5,348,691, the membranes of each cell expand during operation, and tend to move into the air passages, and then, during shut-down, contract as the membrane drys out. As a result, the cell hardware is stressed. Physical deformation of the cell frame supports and retainer sheets has resulted causing air leakage into the cell and non-uniform air flow between the cells. Accordingly, the humidification performance of these devices is less stable and therefore less predictable.

Thus, there is also a need for membrane humidifying devices that provide more stable and more predictable humidification performance.

It is therefore an object of the present invention to provide a method for improving and rendering more stable and predictable the humidification performance of membrane humidifying devices.

It is a more particular object to provide a method for improving water transport in membrane humidifying devices and for reducing membrane shrinkage stress on the cell hardware of such devices.

It is yet a more particular object to provide a method for treating the surfaces of membranes employed in the cells making up membrane humidifying devices so as to effect stable and increased humidification performance from such devices.

It is yet another object of the present invention to provide a membrane humidifying device made up of at least one cell employing membranes having such treated surfaces, and to provide a system employing such a device.

SUMMARY OF THE INVENTION

The present invention therefore relates to a method for improving water transport and reducing shrinkage stress in membrane humidifying devices and to a membrane humidifying device demonstrating increased air humidification rates. The present invention further relates to a system for producing humidified air that employs such a device.

The membrane humidifying device of the present invention comprises at least one membrane cell and a means for introducing water into each cell. The membrane cell(s) is comprised of: at least one sheet of a hydrophilic membrane that is capable of osmotically transporting water; and at least one rigid screen, located adjacent to at least one membrane sheet, for providing even water flow distribution to and support for the membrane sheet(s). The surfaces of the membrane sheet(s) employed in the cell(s) permanently conform to the contours of an adjacent rigid screen.

The system of the present invention comprises:

a. the membrane humidifying device described hereinabove;

b. an optional housing for the device;

c. a means for introducing water into the membrane humidifying device;

d. a means for draining non-absorbed water from the device; and e. a means for controlling the flow of water into the humidifying device.

The method of the present invention comprises:

assembling at least one membrane cell comprising at least one sheet of a dry and contracted hydrophilic membrane and at least one rigid screen;

passing water, having a temperature of from about 45° C. to about 90° C. through the assembled cell(s); while simultaneously applying a vacuum to the cell(s), for a period of at least about 30 minutes.

The above-referenced elevated temperature/vacuum treatment results in a permanent deforming of the surfaces of the membrane sheet(s). The membrane surfaces take on the contours of adjacent rigid screen(s) thereby improving water transport and reducing movement of the membrane surfaces into the airstream during the operation of humidifying devices made up of such membrane cells.

The foregoing and other features and advantages of the present invention will become more apparent from the following description and accompanying drawings.

DESCRIPTION OF THE PREFERRED EMBODIMENT

Figure 1:
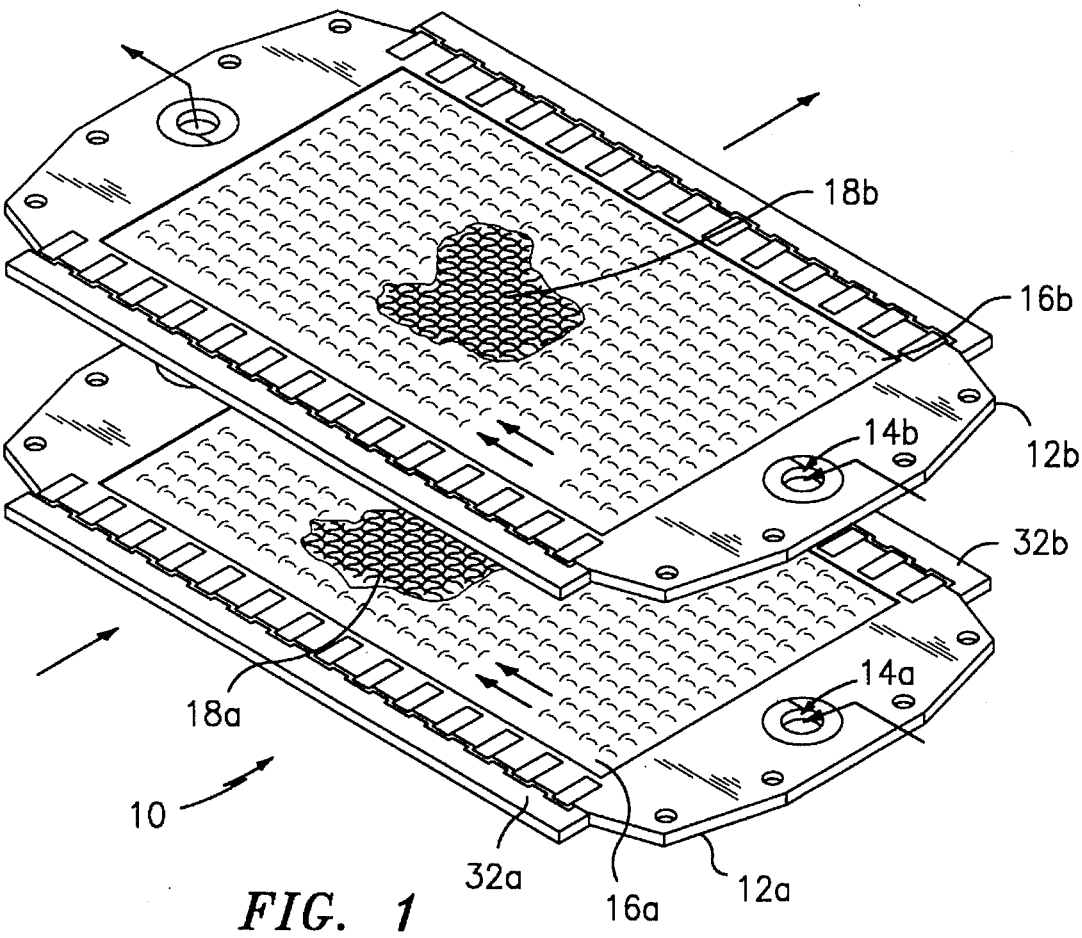
FIG. 1 is a top perspective view of a preferred membrane humidifying device of the present invention, with two membrane cells with water introduction means being shown.

Referring to the drawings in detail, the membrane humidifying device of the present invention is shown generally at 10. The humidifying device 10 is comprised of at least one membrane cell, with two identical cells 12*a* and 12*b* being illustrated in FIG. 1, and a means, e.g., 14*a* and 14*b*, for introducing water into each cell. The membrane cells 12*a*, 12*b* each include at least one sheet, e.g., 16*a* and 16*b*, of a hydrophilic membrane having permanently deformed or molded membrane surfaces, and at least one rigid screen, e.g., 18*a* and 18*b*.

The hydrophilic membrane, e.g., 16*a*, of the present invention can be any surface deformable or moldable membrane capable of attracting and osmotically transporting water, but which prevents the transport of microbes, particulates and dissolved salts across the membrane. Preferred membranes include ion exchange membranes such as polystyrene sulfonic acid and perfluorocarbon sulfonic acid membranes. The most preferred hydrophilic membrane is a perfluorocarbon sulfonic acid membrane. Such membranes are produced by E. I. dupont de Nemours & Co., Inc., Wilmington, Del. and are sold under the product designation NAFION® perfluorosulfonic acid products. A preferred NAFION® product is NAFION® 105 membranes. Similar membranes are produced by Dow Chemical Co. and others.

It has been discovered that when these membranes, e.g., 16*a*, are attached to a cell assembly in a dry, contracted state, stress on membrane retention hardware is reduced or eliminated while cell assembly time is decreased.

Once subjected to the elevated temperature/vacuum treatment of the present inventive method the surfaces of the membranes, e.g., 16*a*, surprisingly become permanently deformed and adopt the contours of a contiguous rigid screen, e.g., 18*a*. The permanently deformed or dimpled surfaces of the membranes, e.g. 16*a*, provide at least a two-fold enhancement in the performance of humidification systems employing devices made up of cells, e.g. 12*a*, having such treated membranes. While not intending to be bound by theory, it is submitted that the first enhancement results from the tendency of the treated membranes, e.g. 16*a*, to move into the openings provided by contiguous rigid screens, e.g. 18*a*, instead of into air flow passages during the operation of the host humidification system. As a result, the system experiences reduced air pressure drop that produces more even air flow distribution. The second enhancement results from the tendency of the deformed or dimpled membrane surfaces to break up the air/membrane boundary layer thereby increasing the convection or heat and mass transfer coefficients. Increased heat and mass transfer coefficients produce higher water transport and humidity levels.

The term "permanently deformed" as used herein is intended to mean that the membranes, e.g., 16*a*, exhibit a permanent memory of the initial elevated temperature/vacuum treatment or hydration. Therefore, subsequent treatments or hydrations of the membranes, e.g., 16*a*, result in the membranes returning to the deformed or dimpled form that resulted from the first hydration. In particular, the deformed membrane surfaces are not restored to their original condition by boiling (e.g., boiling the membrane in water for about twenty minutes), or by subjecting the membrane to repeated expansion/contraction cycles.

The rigid screen, e.g., 18*a*, of the present invention is a metal or plastic screen capable of providing rigid and firm support for the hydrophilic membrane(s), e.g., 16*a*, under moderate pressure gradients. The rigid screen 18*a*, in addition to providing support for the membrane(s) 16*a*, provides even water flow distribution in the membrane cell 12*a*, to eliminate dead zones. The thickness and mesh size of rigid screen 18*a*, is broadly determined on the basis of mass flow rates, pressure and temperature conditions. As will be apparent to those skilled in the art, screens with very small mesh sizes will result in negligible dimpling of the membrane surface while screens with very large mesh sizes will result in membrane surfaces having fewer contours or hills and valleys. As a result, the tendency of the treated membranes to move into the openings provided by these contiguous rigid screens, during operation of a host humidification system, is decreased. Accordingly, the mesh size of rigid screen 18*a* is also determined by the number and size of the openings needed to effect an optimal number of contours in the membrane (e.g., 16*a*) surfaces. It is preferred that screen 18*a* have a mesh size of about 4 to about 12, with mesh sizes of about 6 to about 8 being the most preferred. The screen thickness is preferably from about 0.5 to about 1.5 millimeters (mm), with thicknesses of from about 1.2 to about 1.4 mm being the most preferred. Preferred rigid screen 18*a* is a metal screen that is compatible with a water environment and includes silver, aluminum and stainless steel metal screens.

Figure 2:
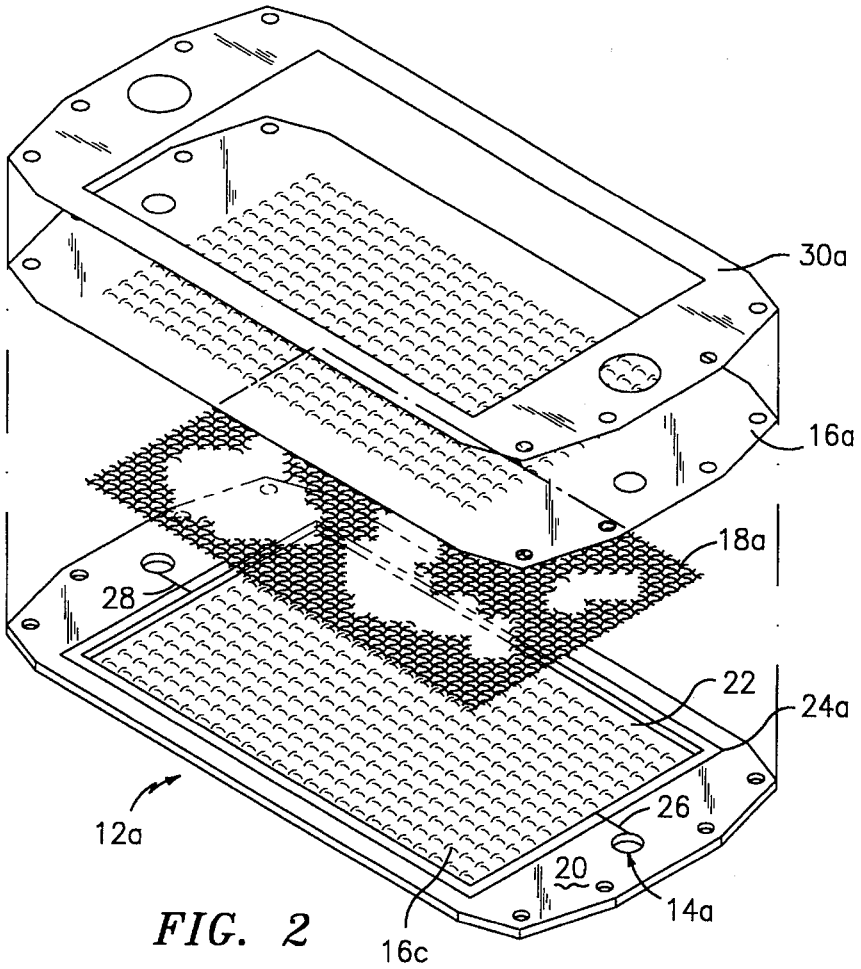
FIG. 2 is an exploded perspective view of one membrane cell of the membrane humidifying device of FIG. 1.

An expanded view of the preferred membrane cell 12*a* with water introduction means 14*a* is shown in FIG. 2. Two membranes 16*a*, 16*c* are positioned on either side of a plastic frame 20 that contains rigid screen 18*a*. The plastic frame 20 has a rectangular shaped aperture 22 formed therein, sealing means 24*a* and 24*b* (not shown), a water inlet port 26 and a water outlet port 28. The rigid screen 18*a* occupies the space defined by the aperture 22 of plastic frame 20. Retainer sheets 30*a* and 30*b* (not shown) are positioned on exterior surfaces of membranes 16*a*, 16*c* and the resulting assembly is clamped together by way of retaining clips 32*a*, 32*b* (as shown in FIG. 1).

The positioning of water inlet port 26 in frame 20 is preferably staggered in relation to water outlet port 28. The staggered relationship allows for a greater flow length through cell 12*a* that results in a greater pressure drop across cell 12*a* when compared to cells having a center line alignment of the inlet and outlet ports.

By way of example, and in accordance with the method of the present invention, cell 12*a* is assembled with membranes 16*a*, 16*c* in a dry, contracted state. Once assembled, water, having a temperature of from about 45° C. to about 90° C., is directed through water inlet port 26, into aperture 22 occupied by rigid screen 18*a*, and out through water outlet port 28. While water is being directed through cell 12*a*, a vacuum is drawn on the cell through outlet port 28 by a mechanical vacuum pump employing a means for preventing liquid from entering the pump. Vacuum pressure is varied to maintain a single phase liquid inside cell 12*a*. This elevated temperature/vacuum treatment is continued for a period of at least about 30 minutes until a permanent deforming of the surfaces of each membrane 16*a*, 16*c* occurs.

Membrane cells assembled and treated according to the present invention realize reduced shrinkage stress on cell hardware, produce acceptable, balanced and repeatable pressure drop, demonstrate increased humidification rates of approximately 60 to 70% when compared to the membrane cells of U.S. Pat. No. 5,348,691 and render stable and predictable humidification performance.

Preferred membrane devices 10 of the present invention comprise from about 2 to about 40 membrane cells, e.g., 12*a*, arranged in parallel configuration, with water introduction means 14.

In operation, the preferred membrane device 10 is positioned in an airstream (e.g., duct work) such that air flows across the outer exposed surfaces of the membranes, e.g., 16*a* and 16*c*, of each cell, e.g., 12*a*, of device 10. Water is introduced into each cell, e.g., 12*a*, through means 14 and, in particular, is directed through water inlet port 26 into aperture 22, where at least a portion of the incoming flow passes through rigid screen 18*a* and is attracted by the hydrophilic membranes 16*a*, 16*c*. That portion of water is then osmotically transported across membranes 16*a*, 16*c* to the outer surfaces where it evaporates into the airstream. It is preferred that the direction of the air flow across the outer surface of membranes 16*a*, 16*c* be different from the direction of the water flow through each cell 12*a*. As stated above, membranes 16*a* and 16*c* prevent the transport of microbes, particulates and dissolved salts across the membrane. Due to a possibility of airborne bacteria growing on the outer air exposed surfaces of membranes 16*a*, 16*c*, it is preferred that membranes 16*a* and 16*c* be dried out on a periodic basis.

Figure 3:
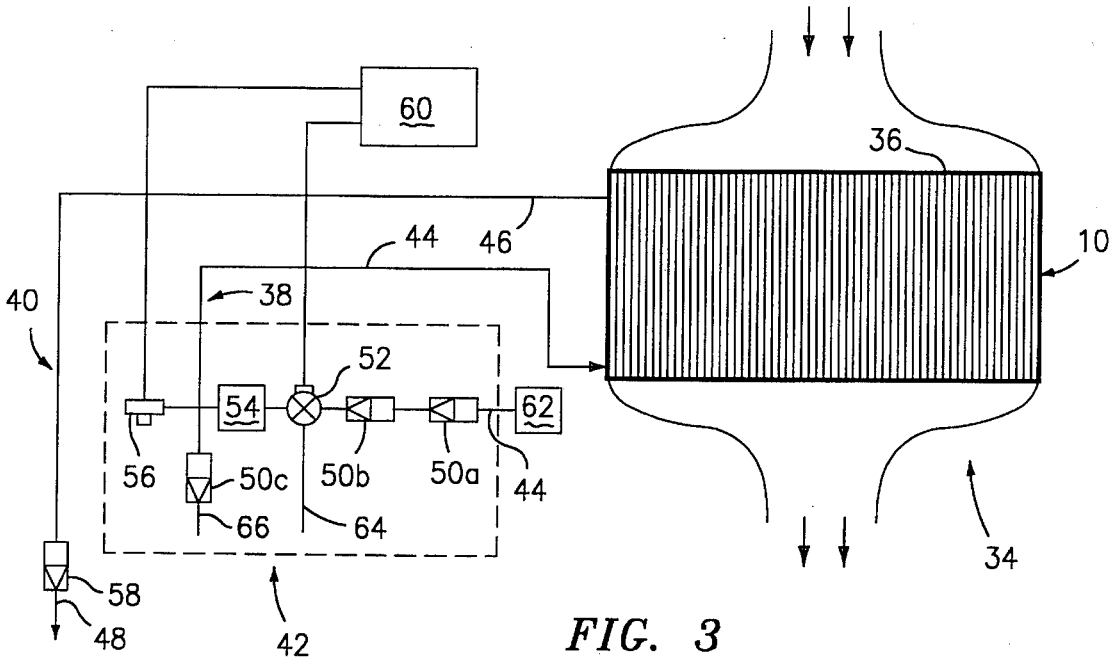
FIG. 3 is a schematic of a preferred system for producing humidified air that employs the membrane humidifying device of the present invention.

Referring now to FIG. 3, a preferred airplane humidification system is shown generally at 34. The preferred system 34 uses potable water and is made up of: membrane humidifying device 10; a housing 36 for the humidifying device 10; a means 38 for the introduction of water into device 10; a means 40 for draining or removing non-absorbed water from device 10; and a means 42 for controlling the flow of water to device 10.

Water introduction means 38 basically comprises water inlet line 44 that is in fluid connection with a potable water source 62 and device 10, while draining means 40 basically comprises water outlet line 46 that is in fluid connection with device 10 and an overboard drain 48. Water flow control means 42 basically comprises: check/relief valves 50*a*, 50*b*, 50*c*; control valve 52; water pressure reducer 54; pressure sensor 56; and check valve 58.

The control valve 52 and the pressure sensor 56 are in electronic contact via an electronic control box 60.

The enhanced humidification rates achieved by the present inventive system 34 are dependent upon the temperature of the air to be humidified in addition to the membranes' (e.g., 16*a* and 16*c*) surface area. Water introduced to the membrane cells (e.g., 12*a*) can be at room temperature or at slightly elevated temperatures. As the temperature of the air flowing over the outer surfaces of the membranes (e.g., 16*a* and 16*c*) increases, humidification rates increase and the required membrane surface area decreases.

The method for producing humidified air utilizing the above-described airplane humidification system 34 comprises positioning the system 34 in the flow path of the air to be humidified and introducing water to membrane humidifying device 10. In particular, water from potable water source 62 is introduced into water inlet line 44 which is in fluid contact with water pressure reducer 54 where the pressure of the water is reduced to a pressure below the pressure of the air to be humidified. The pressure reduced water continues to flow through water inlet line 44 and into device 10. Once inside device 10 water enters each membrane cell, e.g., 12*a*, 12*b*, and a portion of it contacts or passes through the screen(s) (e.g., 18*a*) (not shown), contacts the hydrophilic membranes (e.g., 16*a* and 16*c*) (not shown), and is absorbed and osmotically transported to the outer surfaces of the membranes 16*a*, 16*c* where it evaporates into the airstream. Water that is not absorbed is removed from the membrane humidifying device 10 by means 40 (e.g., water outlet line 46) and is drawn overboard through drain 48 via the low-pressure atmosphere surrounding the aircraft.

Where water is introduced to the membrane humidifying device 10 at a pressure below the pressure of the air to be humidified, a pressure gradient across membranes, e.g., 16*a*, 16*c*, is created. As a result, the possibility of liquid water transport to the air stream in the event of a membrane puncture or tear is eliminated.

Pressure sensor 56 serves to sense or detect positive pressure or a loss of vacuum within system 34. When such a condition is detected, control valve 52 is powered to vent position and check valve 58 closes. As a result, cabin ambient air is drawn into system 34 through air inlet line 64 and control valve 52, and water is drained from device 10 and line 44 through drain line 66 into a holding tank (not shown).

As stated hereinabove, due to the possibility of airborne bacteria growing on the outer air exposed surfaces of the membrane(s) (e.g., 16*a* and 16*c*), it is preferred that the system 34 be periodically shut-down and the water supply to the membrane humidifying device 10 halted to enable the membranes 16*a*, 16*c* to dry out, thereby cutting off the source of nutrients to the bacteria.

The present invention will be further illustrated by reference to the following Examples. The Examples are not intended to limit the generally broad scope of the present invention.

WORKING EXAMPLES

Sample Preparation

Two types of humidification devices were fabricated in an effort to compare the humidification performance of the present inventive membrane humidifying device and a prior art membrane humidifying device. Humidifying device "A", as used hereinbelow, is intended to designate the humidifying device of the present invention. Humidifying device "PA", as used hereinbelow, is intended to designate a prior art humidifying device. For both devices, fiberglass housings having open ends formed to mate with circular ductwork, and measuring 25.6 cm×31.9 cm×15.2 cm, were used along with NAFION® 117 membrane sheets, each measuring 12.5 cm×24.0 cm×0.018 cm thick, and having two die-cut holes, measuring 1.2 cm in diameter, located 1.7 cm from a top and bottom edge.

Humidifying Device "A" Preparation

Device "A" was prepared by assembling 32 membrane cells into a stack by alternating polysulfone spacers (two per membrane cell with each spacer having one die-cut hole measuring 1.2 cm in diameter), and membrane cells, and then by securing the resulting stack by passing eight threaded rods through the stack. The stack had a water inlet port and a water outlet port formed by the die-cut holes in the spacers and in the cell components that measured 16.8 cm in length.

Each membrane cell was made up of an 8 mesh stainless steel screen, measuring 10.2 cm×16.8 cm, that was positioned within a similarly sized central opening of a polysulfone frame that was located between two dry NAFION® 117 membrane sheets. A stainless steel retainer sheet with a central opening measuring 10.2 cm×16.7 cm was positioned on the external surface of each membrane sheet and the resulting assembly clamped together by two elongated stainless steel spring clamps.

Once the stack was prepared, water at a temperature of 65° C. and at a flow rate of 100 ml/min was introduced through the water inlet port and into each membrane cell while a vacuum was applied through the water outlet port for a period of 30 minutes. The stack was then secured in a fiberglass housing.

Humidifying Device "PA" Preparation

Device "PA" was also prepared by assembling 32 membrane cells into a stack by alternating polysulfone spacers (two per membrane cell with each spacer having one die-cut hole measuring 1.2 cm in diameter), and membrane cells, and then by securing the resulting stack by passing eight threaded rods through the stack. The stack also had a water inlet port and a water outlet port formed by the die-cut holes in the spacers and in the cell components that measured 16.8 cm in length.

Each membrane cell was made up of two 25×23 mesh polyethylene screens, each measuring 10.2 cm×16.8 cm, that were positioned within a similarly sized central opening of a polysulfone frame that was located between two wet NAFION® 117 membrane sheets. A stainless steel retainer sheet with a central opening measuring 10.2 cm×16.7 cm was positioned on the external surface of each membrane sheet and the resulting assembly clamped together by two elongated stainless steel spring clamps.

Once the stack was prepared it was secured in a fiberglass housing.

Test Method

Each device was tested for humidification performance by installing the fiberglass housed device into a duct of an "air test cell" built to provide air flows representative of the Environmental Control System of a Boeing 777. The "air test cell" was made up of an air cycle machine that produced dry, pressurized air that was directed into eight circular "simulated cabin air" supply ducts and one circular "simulated cockpit air" supply duct that measured 15.2 cm in diameter. For each test, the device to be tested was installed into the "simulated cockpit air" supply duct about 7.6 meters from the air cycle machine by clamping the fiberglass housing to the duct and by attaching a 0.64 cm in diameter water line directly to the device.

For each test, air, at an initial temperature of 21° C., and at a flow rate of about 11.3 $m^3$/min was introduced into the "simulated cockpit air" supply duct. Water, at a temperature of 22° C., and at a flow rate of 100 ml/min was introduced into the humidifying device being tested.

The temperature of the air in the "simulated cockpit air" supply duct and the temperature of the water entering and exiting the humidifying device was measured by calibrated thermocouples located immediately upstream and downstream of the device being tested. The air thermocouples were located about 30.5 cm from the external surfaces of the membrane sheets of the humidifying device. The water thermocouples were located about 10.2 cm from the inlet port and about 40.6 cm from the outlet port of the device.

Flow rates of the air entering the "simulated cockpit air" supply duct were measured by a 0–30" differential pressure gauge (manufactured by Rosemount Analytical, Inc., Cedar Grove Div., 89-T Commerce Road, Cedar Grove, N.J. 07009) located upstream of the device.

Flow rates of the water entering and exiting the humidifying device were measured by flowing the water through Lee Visco Jets (P/N VDCX0512050B, manufactured by The Lee Company, Technical Center, 2-T Pettipaug Road, Westbrook, Conn. 06498) located in the water line. Flow rates were checked for nominal (e.g., 100 ml/min) flow before and after each test.

Once the inlet air flow rates and temperature and the inlet water flow rates and temperature reached "steady state conditions" (i.e., flow rates and temperatures unchanging for 15 minutes) water exiting the device being tested was collected in a stainless steel cylinder for a period of 20 minutes. Each test was repeated once. The average amount of water added to the airstream by the humidifying device, per test period, was then determined by multiplying the average inlet water flow rate by the test period (i.e., 20 minutes) and then subtracting the average volume of water collected.

The temperature of the inlet air was then increased in increments of 8.3° C. and the water exiting the humidifying device again collected at each incremently increased air inlet temperature as detailed above. The average amount of water added to the airstream by the device being tested, per test period, at each air inlet temperature, was then calculated as set forth above.

EXAMPLES 1 AND C1

Figure 4:
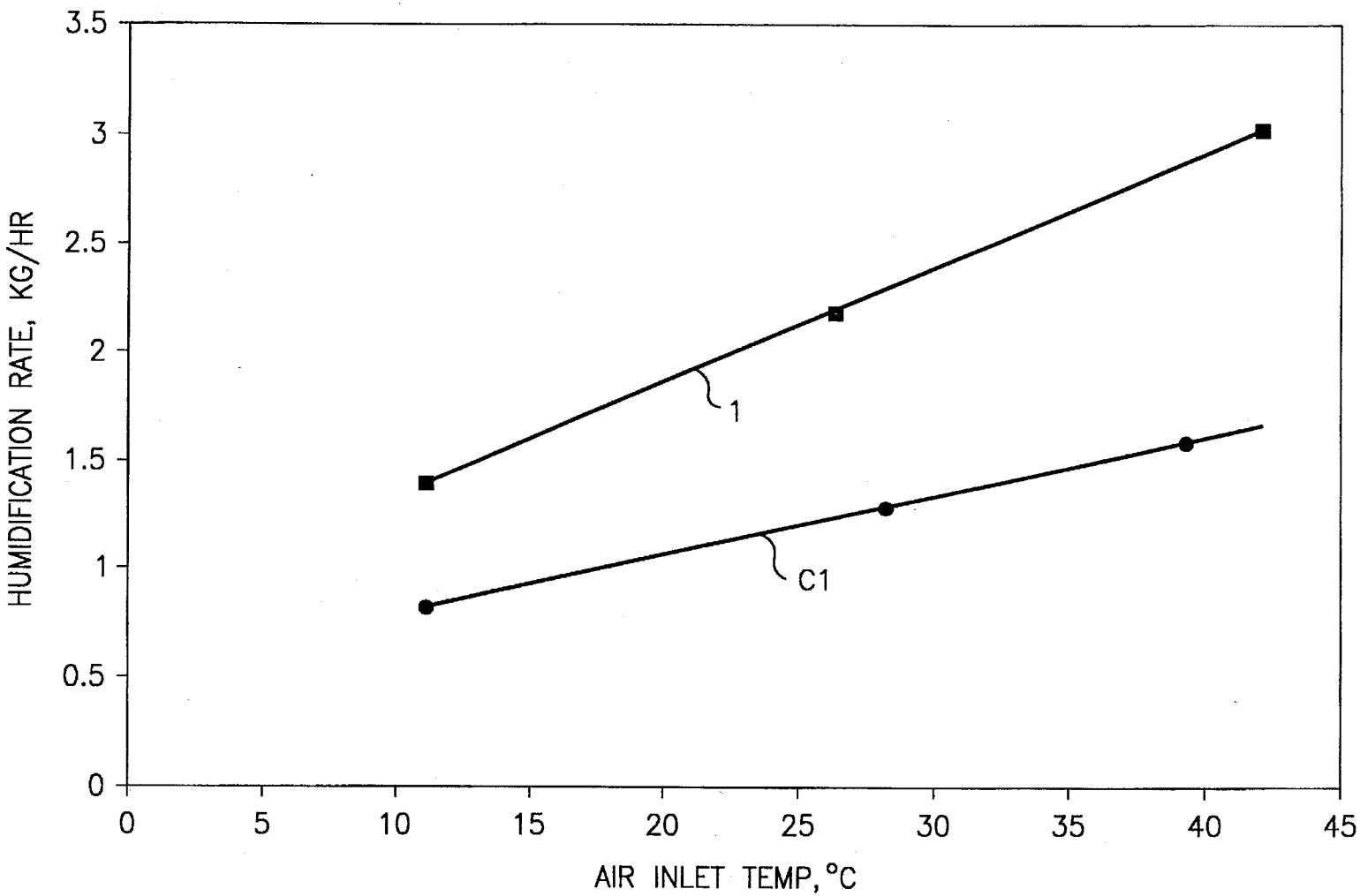
FIG. 4 is a graph displaying humidification rates for the present inventive device and for a prior art device at various air inlet temperatures.

In these examples the prepared humidifying devices were subjected to the above-described test and the results plotted in the graph displayed in FIG. 4.

Referring to FIG. 4, which is meant to be exemplary, not limiting, the amount of water delivered to the airstream by humidifying device "A" of the present invention and by the prior art device "PA" at specific air inlet temperatures, are noted. Line 1 refers to humidifying device "A" while line C1 refers to humidifying device "PA".

As is readily apparent from this graph the humidifying device of the present invention demonstrates enhanced humidification performance as compared to the prior art device.

While particular embodiments of this invention have been shown, it will be appreciated by those skilled in the art that various changes in form and detail thereof may be made without departing from the spirit and scope of the present invention.

Having thus described the invention what is claimed is:

1. A method for improving water transport and reducing shrinkage stress in a membrane humidifying device that produces humidified air, wherein said humidifying device comprises at least one membrane cell and a means for introducing water into each said cell, wherein said method comprises:

assembling at least one membrane cell which comprises: at least one sheet of a dry and contracted hydrophilic membrane having a first surface and a second surface, that is capable of osmotically transporting water from said first surface to said second surface, and at least one rigid screen, located contiguous to at least one membrane sheet, for providing even water flow distribution to and support for said membrane sheet(s);

passing water, having a temperature of from about 45° C. to about 90° C., through said assembled cell(s), while simultaneously applying a vacuum to said cell(s), for a period of at least about 30 minutes until at least said first surface of each said membrane sheet permanently conforms to a surface of a contiguous rigid screen.

2. The method of claim 1, wherein said hydrophilic membrane is an ion exchange membrane selected from the group consisting of perfluorocarbon sulfonic acid membranes and polystyrene sulfonic acid membranes.

3. The method of claim 2, wherein said hydrophilic membrane is a perfluorocarbon sulfonic acid membrane.

4. The method of claim 3, wherein said rigid screen is a metal screen having a mesh size of from about 6 to about 8 and a thickness of from about 1.2 to about 1.4 millimeters.

5. The method of claim 1, wherein said rigid screen is a metal screen and wherein said metal is selected from the group consisting of silver, aluminum, stainless steel and mixtures thereof.

6. The method of claim 5, wherein said metal screen has a mesh size of from about 4 to about 12 and a thickness of from about 0.5 to about 1.5 millimeters.

7. A membrane humidifying device demonstrating improved humidification rates which comprises at least one membrane cell and a means for introducing water into each said cell, wherein said membrane cell(s) comprises:

at least one sheet of a hydrophilic membrane having a first surface and a second surface, that is capable of osmotically transporting water from said first surface to said second surface; and at least one rigid screen, located contiguous to at least one membrane sheet, for providing even water flow distribution to and support for said membrane sheet(s), wherein said membrane cell(s) is assembled when said membrane sheet(s) is in a dry and contracted state, and wherein at least said first surface of each said membrane sheet permanently conforms to a surface of a contiguous rigid screen.

8. The membrane humidifying device of claim 7, wherein said membrane cell(s) comprises the following three contiguous layers:

a. a first sheet of said hydrophilic membrane;

b. one said rigid screen; and c. a second sheet of said hydrophilic membrane.

9. The membrane humidifying device of claim 7, wherein said hydrophilic membrane is an ion exchange membrane selected from the group consisting of perfluorocarbon sulfonic acid membranes and polystyrene sulfonic acid membranes.

10. The membrane humidifying device of claim 9, wherein said hydrophilic membrane is a perfluorocarbon sulfonic acid membrane.

11. The membrane humidifying device of claim 10, wherein said rigid screen is a metal screen having a mesh size of from about 6 to about 8 and a thickness of from about 1.2 to about 1.4 millimeters.

12. The membrane humidifying device of claim 7, wherein said rigid screen is a metal screen and wherein said metal is selected from the group consisting of silver, aluminum, stainless steel and mixtures thereof.

13. The membrane humidifying device of claim 12, wherein said metal screen has a mesh size of from about 4 to about 12 and a thickness of from about 0.5 to about 1.5 millimeters.

14. A system for producing humidified air which comprises:

a membrane humidifying device;

b. an optional housing for said membrane humidifying device;

c. a means for introducing water into said membrane humidifying device;

d. a means for draining or removing non-absorbed water from said membrane humidifying device; and e. a means for controlling the flow of water into said membrane humidifying device, wherein said membrane humidifying device comprises at least one membrane cell and a means for introducing water into each said cell, wherein said membrane cell(s) comprises:

at least one sheet of a hydrophilic membrane having a first surface and a second surface, that is capable of osmotically transporting water from said first surface to said second surface; and at least one rigid screen, located contiguous to at least one membrane sheet, for providing even water flow distribution to and support for said membrane sheet(s), wherein said membrane cell(s) is assembled when said membrane sheet(s) is in a dry and contracted state, and wherein at least said first surface of each said membrane sheet permanently conforms to a surface of a contiguous rigid screen.

15. The system for producing humidified air of claim 14, wherein said membrane cell(s) comprises the following three contiguous layers:

a. a first sheet of said hydrophilic membrane;

b. one said rigid screen; and c. a second sheet of said hydrophilic membrane.

16. The system for producing humidified air of claim 14, wherein said hydrophilic membrane of said membrane cell(s) is an ion exchange membrane selected from the group consisting of perfluorocarbon sulfonic acid membranes and polystyrene sulfonic acid membranes.

17. The system for producing humidified air of claim 16, wherein said hydrophilic membrane is a perfluorocarbon sulfonic acid membrane.

18. The system for producing humidified air of claim 17, wherein said rigid screen is a metal screen having a mesh size of from about 6 to about 8 and a thickness of from about 1.2 to about 1.4 millimeters.

19. The system for producing humidified air of claim 14, wherein said rigid screen of said membrane cell(s) is a metal screen and wherein said metal is selected from the group consisting of silver, aluminum, stainless steel and mixtures thereof.

20. The system for producing humidified air of claim 19, wherein said metal screen has a mesh size of from about 4 to about 12 and a thickness of from about 0.5 to about 1.5 millimeters.

* * * * *

UNITED STATES PATENT AND TRADEMARK OFFICE

CERTIFICATE OF CORRECTION

PATENT NO. : 5,595,690

DATED : January 21, 1997

INVENTOR(S) : Thomas R. Filburn, John C. Huddleston and Dean A. Killelea

It is certified that error appears in the above-indentified patent and that said Letters Patent is hereby corrected as shown below:

tle page, Item [73], change "Hamilton Standard, Windsor Locks, Conn." to --United Technologies Corporation, Hartford, Connecticut--.

Signed and Sealed this

Ninth Day of September, 1997

*Attest:*

Bruce Lehman

BRUCE LEHMAN

*Attesting Officer*

*Commissioner of Patents and Trademarks*